US006409571B1

(12) United States Patent
Rambaldi

(10) Patent No.: US 6,409,571 B1
(45) Date of Patent: Jun. 25, 2002

(54) MECHANICAL BIPED ASSEMBLY

(76) Inventor: Carlo Rambaldi, 18409 Bryant St., Northridge, CA (US) 91325

( * ) Notice: Subject to any disclaimer, the term of this patent is extended or adjusted under 35 U.S.C. 154(b) by 0 days.

(21) Appl. No.: 09/972,637

(22) Filed: Oct. 9, 2001

(51) Int. Cl.[7] ..... A63H 3/46; A63H 13/00

(52) U.S. Cl. ..... 446/330; 446/359; 446/367; 446/376

(58) Field of Search ..... 446/330, 331, 446/351, 359, 360, 365, 366, 367, 368, 376, 383, 384

(56) References Cited

U.S. PATENT DOCUMENTS 4,141,176 A * 2/1979 Flicker et al. ..... 446/359
6,200,192 B1 * 3/2001 Hou ..... 446/376

* cited by examiner

*Primary Examiner*—Jacob K. Ackun
(74) *Attorney, Agent, or Firm*—Albert O. Cota

(57) ABSTRACT

A mechanical biped assembly (10) consisting of a base assembly (12) which includes a lower section (14) that is hinged to an upper enclosure (28). Attached to the upper enclosure (28) is a biped body (60) consisting of a pelvic enclosure (62) that is supported by a left leg (102) and a right leg (112) and that has pivotally attached a thorax enclosure (124). The thorax enclosure (124) has pivotally attached a left arm (160), a right arm (170), a rotatable neck (186) to which is pivotally attached a head (200). Within the base assembly (12) and the biped body (60) is located a kinematical linkage mechanism (214) that is activated by a single push of the upper enclosure (28). When the mechanism (214) is activated, the thorax enclosure (124) pivots to the right, which is then subsequently followed by the left arm (160) pivoting upward, the right arm (170) moving to the right, and the head (200) rotating to the left and pivoting upward.

20 Claims, 5 Drawing Sheets

MECHANICAL BIPED ASSEMBLY

TECHNICAL FIELD

The invention pertains to the general field of animatronics and more particularly to a mechanical biped assembly incorporating a kinematical mechanism utilizing mechanical links, levers and gears that function in combination to simulate a plurality of simultaneously activated biped movements.

BACKGROUND ART

For as long as there have been "characters" —human, animal and especially characters created from popular entertainment sources such movies or TV shows, people have desired to own them. This fact can be seen especially with children, who see a movie or a TV show, and become infatuated with one or more of the personalities. Many innovative companies have capitalized on the popularity of these characters by making and selling "dolls" based on the movie and TV personalities as well as figures based on printed publications. These dolls have been popular for generations with the dolls being passed from parent to child.

It is common practice today that whenever certain new television series or movies are released, many or all of the principal characters are produced as "dolls" or "action figures", as well as trading cards, posters, etc. The amount of money that can be made from the sales of these related products can be significant.

It is also common for many of the movie and TV characters to be produced as both "toys", to be played with by children, and also as "collector pieces", to be collected and displayed primarily by adults. Typically, the collector pieces will be more detailed and even include a "certificate of authenticity", especially when the item is made in a limited number series. As can be expected, the collector pieces are also significantly more expensive. This is a result of the manufacturer knowing that a children's toy will probably lead a much harder life, and may be broken, lost, etc. in a relatively short period. The collectors pieces, which often have moving elements, are generally not meant to be "played" with.

Of course, some people do purchase the collectors pieces for children. Many children especially older children have become astute enough to realize and appreciate that certain "toys" should be cared for. Parents who purchase the collector pieces for themselves, or their children, are usually aware that if proper care is given the figures, their value can quickly and substantially rise.

A search of prior art patents and related literature did not uncover any art that included the particular combination of elements that are incorporated into the inventive mechanical biped assembly.

DISCLOSURE OF THE INVENTION

The mechanical biped assembly disclosed herein is presented as an animated creature, and preferably as an animated extraterrestrial creature that is designed to simulate a plurality of biped movements. In its basic design configuration the mechanical biped assembly consists of:

a) a base assembly consisting of a lower section that is hinged to an upper enclosure such that the upper enclosure is biased in an upward direction, b) a biped body consisting of:

(1) a pelvic enclosure having attached a left leg and a right leg, and (2) a pivotally attached thorax enclosure having pivotally attached a right arm, a left arm, a rotatable neck, and a pivoted head, and c) a kinematical linkage mechanism located within the base assembly and the biped body.

The kinematical linkage mechanism is comprised of the following five individual mechanisms:

(1) A thorax movement mechanism that causes the thorax enclosure to pivot to the right for a distance of approximately 0.5 inches (1.27 cm).

(2) A left-arm movement mechanism that causes the left arm to pivot upward to approximately 150-degrees.

(3) A right arm movement mechanism that causes the right arm to move to he right approximately 30-degrees.

(4) A horizontal neck and head rotation mechanism that causes the neck and head to rotate to the left to approximately 90-degrees.

(5) A vertical head rotation mechanism that causes the head to pivot upward to approximately 45-degrees.

The kinematical linkage mechanism is simply activated by a single push of the upward-biased upper enclosure. This action initially causes the thorax movement mechanism to be activated which then sequentially causes the remaining mechanisms to automatically proceed.

In view of the above disclosure, the primary object of the invention is to produce a mechanical biped mechanism that:

Can be made in the form of any biped creature,

Can serve as a toy or as collectors item,

Can be easily molded of plastic or resin,

Can be made in various sizes,

Is reliable and relatively maintenance free, and

Is cost effective from both a manufacturing and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 2:
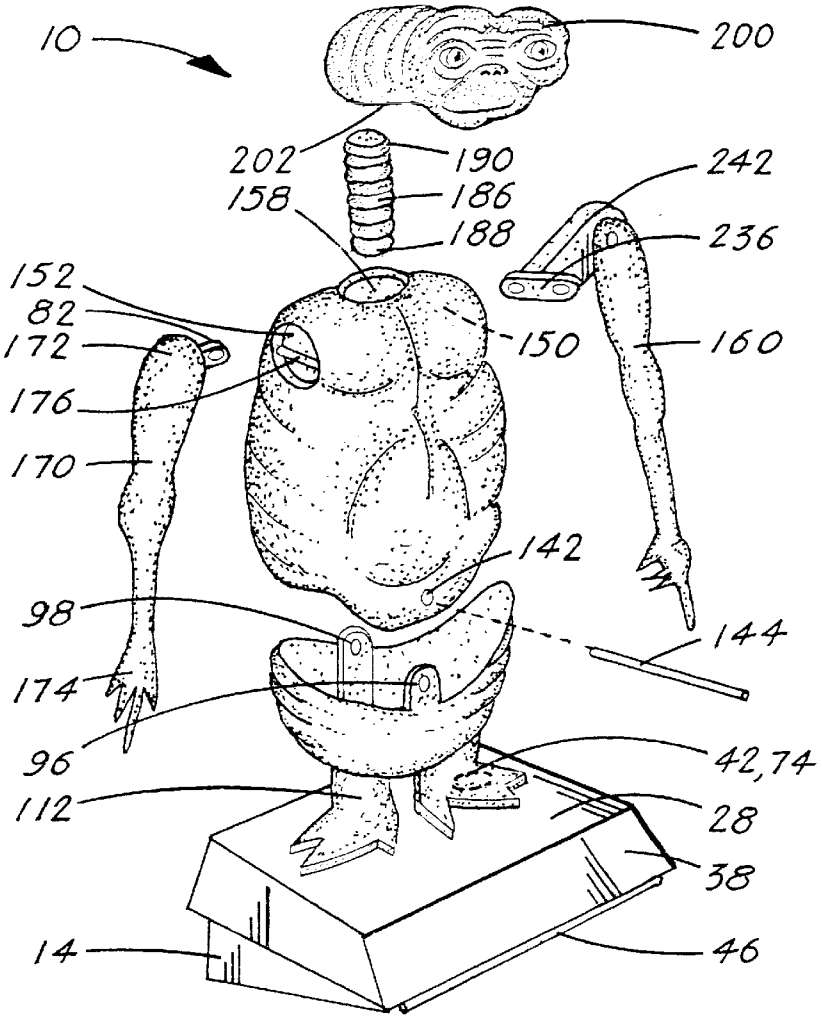
FIG. 2 is an exploded perspective view of the biped body and the base assembly.
Figure 1:
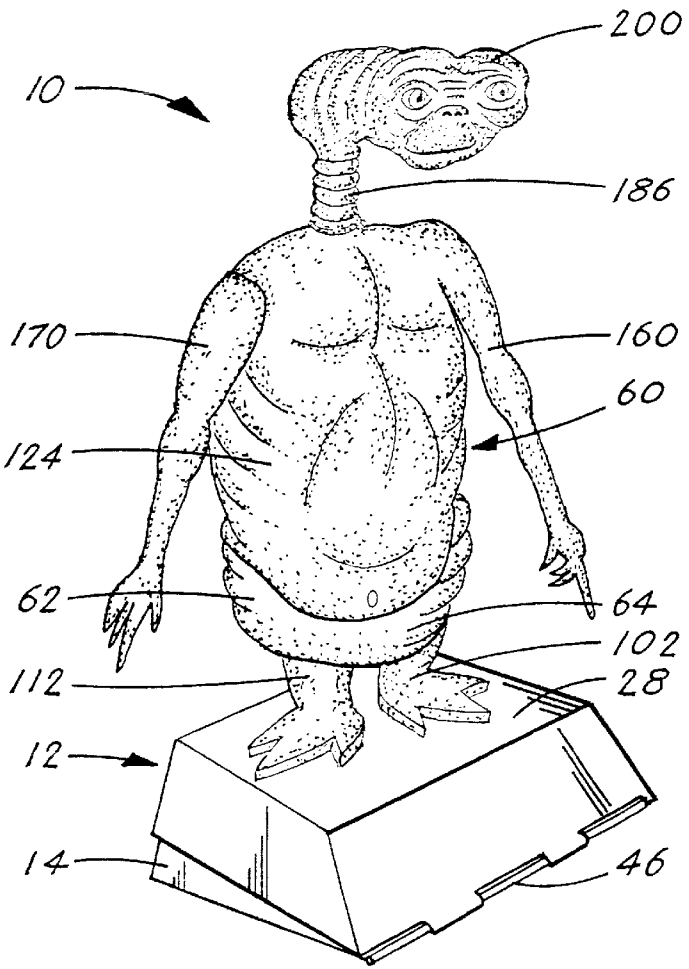
FIG. 1 is a perspective view of a biped body in the form of an extraterrestrial creature attached to a base assembly.

The best mode for carrying out the invention is presented in terms of a preferred embodiment for a mechanical biped assembly that incorporates a kinematical linkage mechanism. The mechanism, which is activated by a single depression of an articulated base assembly, produces a plurality of simultaneous biped movements.

The preferred embodiment of the mechanical biped assembly 10, as shown in FIGS. 1–9, is comprised of three major elements: a base assembly 12, a biped body 60, and a kinematics linkage mechanism 214. The biped body 60 can be configured as a child, an animal, an extraterrestrial creature or any other fanciful creature. However, for the purpose of the instant patent application the biped body 60 will be described with reference to an extraterrestrial creature as depicted in all the figures.

The base assembly 12, as shown in FIGS. 1–3 and 9, is comprised of a lower section 14 and an upper enclosure 28. The lower section 14 includes a rear panel 16, a left panel 18, a right panel 20, and a lower panel 22 which further includes a front edge 24. The upper enclosure 28, which is dimensioned to sidably fit over the lower section 14, is comprised of a rear panel 30, a left panel 32, a right panel 34, an upper panel 36 and a front panel 38 that terminates with a lower edge 40. The upper panel 36 has an enclosure left foot opening 42 that is located adjacent the rear and left panels 30, 32, and a right foot attachment rod bore 44 that is located adjacent the rear and right panels 30, 34. To complete the external configuration of the base assembly 12, a hinge 46 is attached between the front edge 24 of the lower section 14 and the lower edge 40 of the of the upper enclosure 28.

Figure 9:
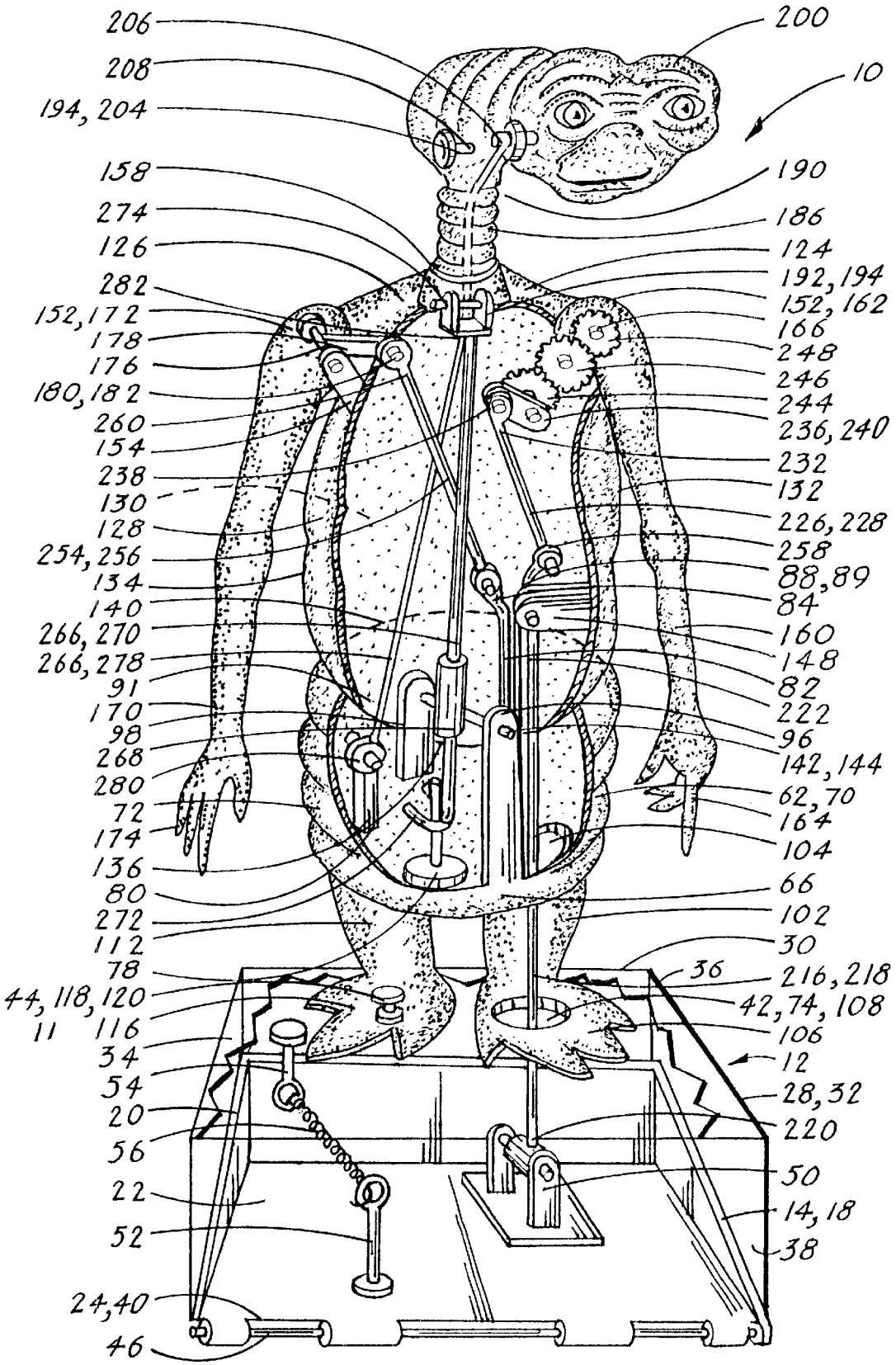
FIG. 9 is an elevational cut-away view of the mechanical biped assembly.

Within the lower section 14 and the upper enclosure 28, as best shown in FIG. 2, is a swivel pin bracket 50, a lower spring-attachment rod 52, an upper spring-attachment rod 54, and a spring 56. The swivel pin bracket 50 is attached to the lower to panel 22 of the lower section 14 adjacent the rear and left panels 16, 18. The lower spring-attachment rod 52 is attached to the lower panel 22 of the lower section 14 adjacent the right panel 20 and the front edge 24. The upper spring-attachment rod 54 is attached to the upper panel 36 of the upper enclosure 28 adjacent the left and right panels 32, 34. The spring 56, which is attached between the lower and upper spring-attachment rods 52, 54, as best shown in FIG. 9, maintains the rear panel 30 of the upper enclosure 28 biased in an upward position but within the confines of the lower panel 22 on the lower section 14. When the upper enclosure 28 is depressed, the kinematical linkage mechanism 214 is activated as described in detail infra.

The biped body 60, as shown in FIGS. 1–9, is comprised of a pelvic enclosure 62, a left leg 102, a right leg 1 12, a thorax enclosure 124, a left arm 160, a right arm 170, a neck 186, and a head 200.

The pelvic enclosure 62 has an enclosed lower section 64 that is integrally molded with a front section 66, a rear section 68, a left section 70 and a right section 72. The lower section 64 includes a pelvic left leg opening 74 that is located adjacent the left section 70, a neck rod support 78 that is attached to the right of a vertical center line 76 that bisects the biped body 60, a head rod support 80 that is attached adjacent the right section 72, a right-arm rod support 82 having an upper end 84 and a lower end 86, and a left-arm rod support 88 having an upper end 89 and a lower end 90, wherein the lower ends 86 and 90 are attached to the left of the vertical center line 76. The pelvic enclosure also includes an open upper section 91 that has a front edge 92 and a rear edge 94. As best shown in FIG. 2, along the vertical center line 76, adjacent the front edge 92 and the rear edge 94 are respectively located a front rod bracket 96 and a rear rod bracket 98.

The left leg 102, as best shown in FIGS. 2 and 9, has an upper pelvic opening 104 and a left foot 106 having an enclosure opening 108. The upper pelvic opening 104 is placed and attached over the pelvic left leg opening 74 located on the pelvic enclosure 62, and the enclosure opening 108 is placed and attached over the enclosure left foot opening 42 located on the upper enclosure 28. The right leg 112, as also best shown in FIG. 2, has an upper surface 114 and a right foot 116 having attached thereto a threaded bolt 118. The upper surface 114 is attached adjacent the right side of the enclosed lower section 64 of the pelvic enclosure 62, and the threaded bolt 118 is inserted into the right foot attachment bore 44 located on the upper enclosure 28. The threaded bolt 118 is subsequently tightened against the upper panel 36 of the upper enclosure by a threaded nut 120.

The thorax enclosure 124, as shown in FIGS. 1-9, is comprised of an enclosed upper section 126 and an open lower section 136. The upper section 126 is integrally formed with a front section 128, a rear section 130, a left section 132, and a right section 134. The open lower section 136 has a front edge 138, a rear edge 140 and is dimensioned and shaped to slidably fit into the open upper section 91 of the pelvic enclosure 62.

Located along the vertical center line 76 and adjacent the front edge 138 and the rear edge 140 of the open lower section 136 are thorax pin bores 142. When a thorax attachment pin 144 is inserted through each of the two thorax pin bores 142 and into the respective front and rear rod brackets 96, 98, located on the pelvic section 62, the thorax enclosure 124 is pivotally attached to the pelvic enclosure 62.

The thorax enclosure 124 also includes: a swivel pin bracket 148 that is attached to the left section 132 adjacent the enclosed upper section 126; a left arm opening 150 located on the left section 132 adjacent the enclosed upper section 126; a right arm opening 152 located on the right section 134 adjacent the enclosed upper section 126, wherein protruding from the right arm opening 152 is a right-arm pin support 154; and a neck opening 158 substantially centered on the enclosed upper section 126.

Figure 4:
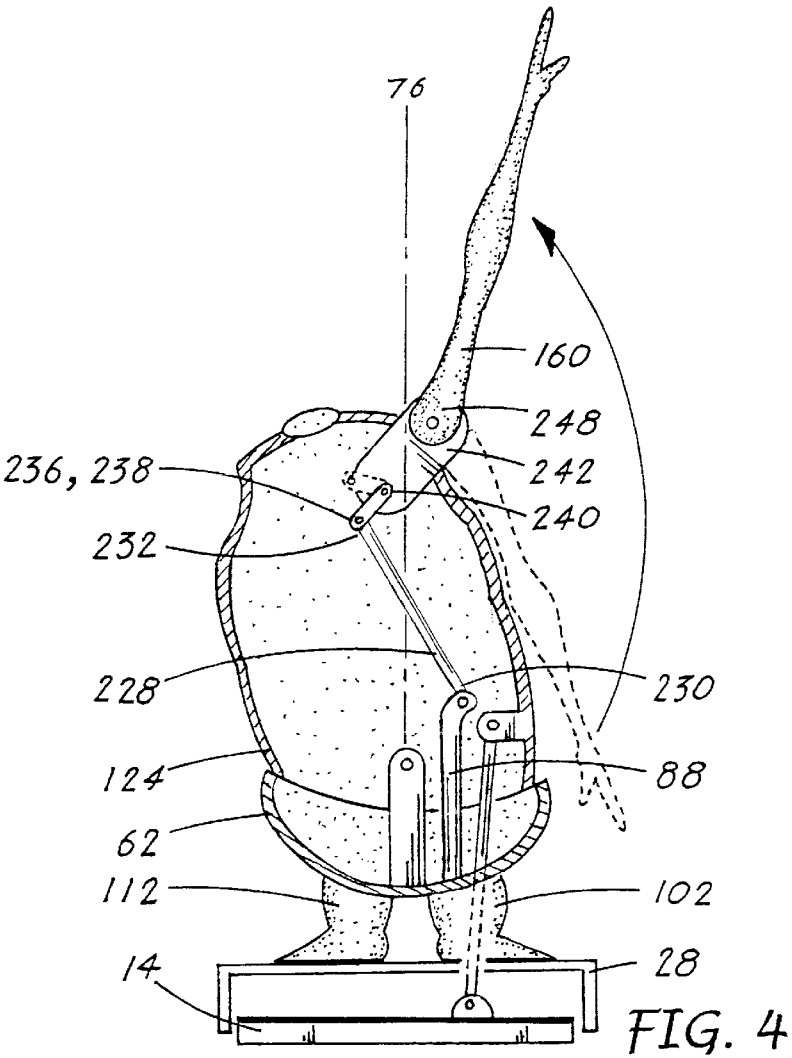
FIG. 4 is a partial elevational/sectional view of a left-arm that is pivoted from a downward position to an upward position by a left-arm movement mechanism.
Figure 5:
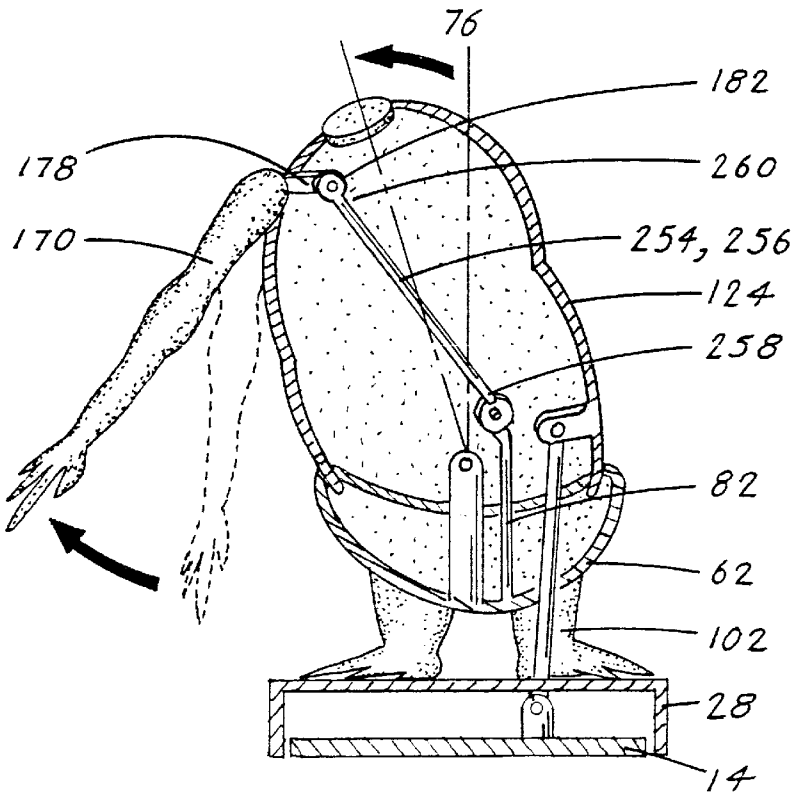
FIG. 5 is a partial elevational/sectional view of a right arm that is moved to the right by a right-arm movement mechanism.

The left arm 160, as shown in FIGS. 2, 4 and 9, has an upper end 162 and a hand 164. The upper end 162 is shaped and dimensioned to be inserted into the left arm opening 150 and includes a gear support pin 166. Likewise, the right arm 170, as shown in FIGS. 2, 5 and 9, has an upper end 172 and a hand 174. The upper end 172 is shaped and dimensioned to be inserted into the right arm opening 152 and includes an outward-extending arm pin 176 that is rotatably inserted into the right arm pin support 154 located on the thorax enclosure 124. The arm pin 176 has attached normal to its surface a right-arm lever 178 having an outer end 180 with a normally-extending rod attachment pin 182.

The neck 186, as shown in FIGS. 2, 6, 8 and 9, includes a lower edge 188 and an upper edge 190, wherein the lower edge 188 is shaped and dimensioned to be pivotally inserted into the neck opening 158. Adjacent the lower edge 188 is a neck support-rod pin bore 192, and adjacent the upper edge 190 is a head pin bore 194.

The final element that comprises the biped body 60 is a head 200, as shown in FIGS. 2, 6, 7, 8 and 9. The head 200 has a neck opening 202 that is shaped and dimensioned to pivotally receive the upper edge 190 of the neck 186. The neck opening 202 further has adjacent thereto a neck pin bore 204, and forward of the neck pin bore 204 is a rod attachment pin 206. When a pin 208 is inserted through the neck pin bore 204 and the head pin bore 194 the head 200 is pivotally attached to the upper edge 190 of the neck 200.

The mechanical biped assembly 10 is designed to simulate a plurality of biped movements which are produced by the kinematical linkage mechanism 204, as shown in FIGS. 3–6 and 9. The mechanism 204, which is activated by simply pressing downward on the upper enclosure 28, is comprised of individual mechanisms that control the movement of the thorax, the left arm, the right arm, the neck and the head.

Figure 3:
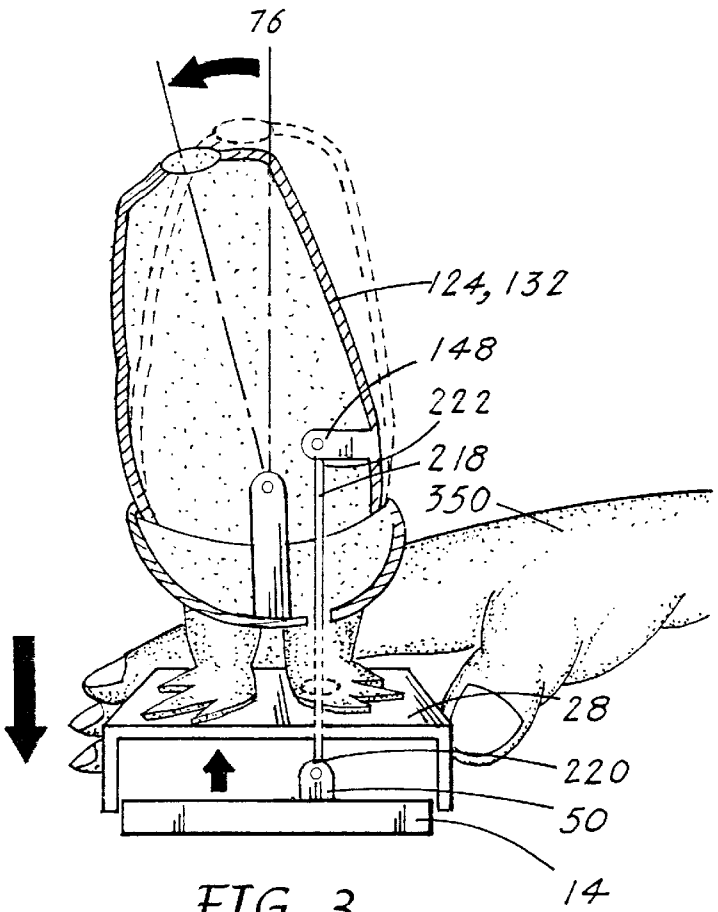
FIG. 3 is a partial elevational/sectional view of a thorax enclosure and a hand activating a thorax movement mechanism which causes the thorax enclosure to pivot to the right.

A thorax movement mechanism means 216, as shown best in FIGS. 3 and 9, is comprised of a thorax rod 218 that includes a lower end 220 and an upper end 222. The lower end 220 is rotatably attached to a pin that is inserted through the swivel pin bracket 50 located on the lower section 14 of the base assembly 12. The upper end 222 is rotatably attached to a pin that is inserted through the swivel pin bracket 148 located on the left section 132 of the thorax enclosure 124. When the upper enclosure 28 is depressed, such as by a hand, as shown in FIG. 3, the kinematical linkage mechanism 214 is activated, thus causing the biped body 60 to move downward, which effectively causes the thorax rod 218 to move upward. The upward movement of the rod 218 causes the thorax enclosure 124 to pivot to the right of the vertical center line 76 for a distance between 0.25 inches (0.635 cm) and 0.75 inches (1.91 cm), which then activates the remaining biped body movements.

A left-arm movement mechanism means 226, as shown best in FIGS. 4 and 9, is comprised of a left-arm rod 228, a gear rotation lever 236, and a gear enclosure 242. The left-arm rod 228 has a lower end 230 and an upper end 232, wherein the lower end 230 is rotatably attached to a pin that is inserted through the left-arm rod support 88 located on the pelvic enclosure 62. The gear rotation lever 236 has a first end 238 and a second end 240, wherein the first end 238 is rotatably attached to a pin that is inserted through the upper end 232 of the left-arm rod 228. The gear enclosure 242 contains three gears, as shown in FIG. 9. The first gear 244 rotates counter-clockwise and is rotatably attached to the second end 240 of the gear rotation lever 236, the second gear 246 rotates clockwise and meshes with the first gear 244, and the third gear 248 rotates counter-clockwise and is attached to the gear support pin 166 located on the upper end 162 of the left arm 160. The first and second gears each have between thirteen and nineteen teeth, and third gear has between eight and twelve teeth. The left-arm movement mechanism 226 is designed to produce an upward left arm movement, as shown in FIG. 4, that ranges between 140-degrees and 160-degrees.

A right arm movement mechanism means 254, as shown in FIGS. 5 and 9, is comprised of a right arm rod 256 that includes a lower end 258 and an upper end 260. The lower end 258 is rotatably attached to a pin that is inserted through the right-arm rod support 82 located on the pelvic enclosure 62. Likewise, the upper end 260 is rotatably attached to the rod attachment pin 182 extending from the right arm lever 178. The right arm movement mechanism 254 is designed to produce an upward right arm movement ranging between 15-degrees and 45-degrees.

The final two kinematical linkage mechanisms described are the horizontal neck and head rotation mechanism means 266 and the vertical head rotation mechanism means 276, both of which are disclosed in two designs.

Figure 6:
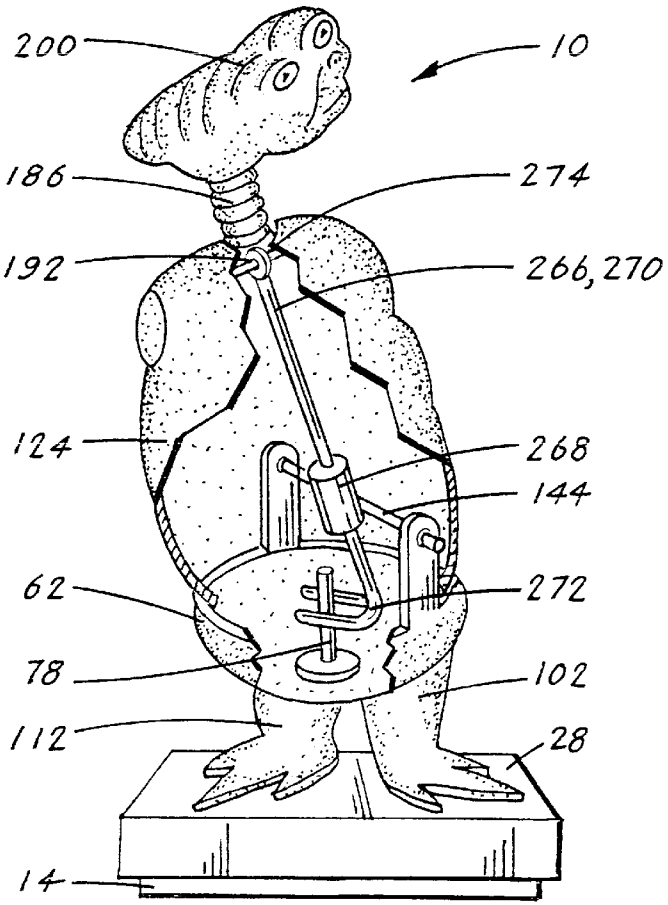
FIG. 6 is a partial elevational/sectional view of a first design for a horizontal neck and head rotation mechanism that causes the neck and head to rotate to the left.

The first design for the horizontal neck and head rotation mechanism means 266, as shown in FIGS. 6 and 9, incorporates a neck support rod sleeve 268 that is rigidly attached to a side of the thorax attachment pin 144. Through the sleeve 268 is rotatably inserted a neck support rod 270 having a lower bifurcated end 272 and an upper end bore 274. The bifurcated end 272 is dimensioned to slip into neck rod support 78 located on the pelvic section 62, and the bore 274 is aligned with the neck support rod pin bore 192 located on the neck 186. When a pin is inserted through the upper end bore 274 and the pin bore 192, the neck 186 is rotatably attached to the thorax enclosure 124.

Figure 7:
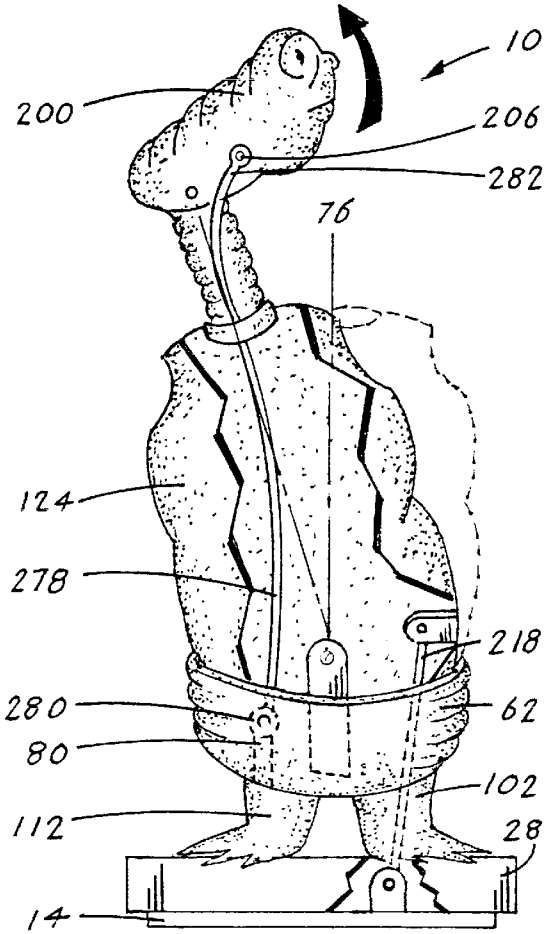
FIG. 7 is a partial elevational/sectional view of a first design for a vertical head rotation mechanism that causes the head to pivot upward.

The first design for the vertical head rotation mechanism means 276, as shown in FIGS. 7 and 9, includes a flexible head rod 278 having a lower end bore 280 and an upper end 282. The lower end bore 280 is rotatably attached to the head rod support 80, and the upper end 282 is rigidly attached to the rod attachment pin 206 located on the head 200, which allows the head 200 to vertically pivot about the head pin 208.

Figure 8:
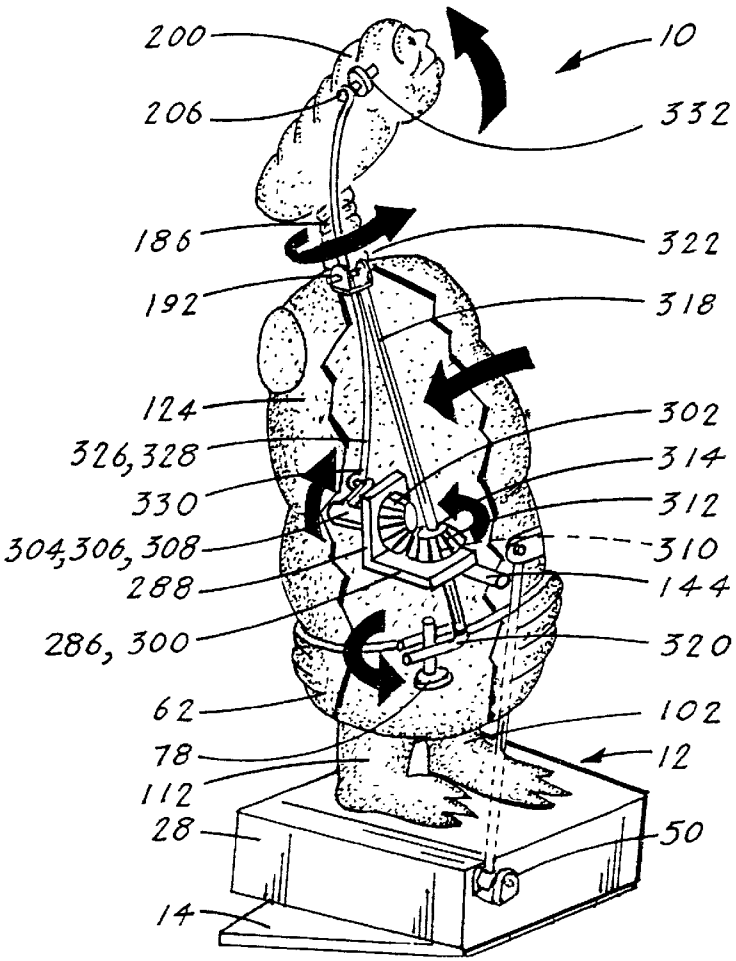
FIG. 8 is a partial elevational/sectional view of a second design for a horizontal neck and head rotation mechanism that causes the head to pivot upward.

The second design for the horizontal neck and head rotation mechanism means 266, as shown in FIG. 8 incorporates a gear support bracket 286 and a neck support rod 318. The bracket 286 is rigidly attached to a side of the thorax attachment pin 144 and has a vertical section 288 and a horizontal section 300. The vertical section 288 is designed to rotatably support a vertical miter gear 302 having a rear extending section 304 from where extends normal a lever arm 306 and a centrally-aligned head rod attachment pin 308. The horizontal section 300 has a rod bore 310, that is dimensioned to rotatably support a horizontal miter gear 312, which also has a rod bore 314 in alignment with the rod bore 310, and that meshes with the vertical miter gear 302. The neck support rod 318 is rigidly positioned into the rod bore 314 in the horizontal miter gear 312, and rotatably inserted into the rod bore 310 in the horizontal section 300. The rod 318 has a lower bifurcated end 320 that slips into the neck rod support 78 located on the pelvic enclosure 62, and an upper end bore 322 that is aligned with the neck support-rod pin bore 192 located in the neck 186. When a pin is inserted through the upper end bore 322 and the neck support-rod pin bore 192, the neck 186 is rotatably attached to the thorax enclosure 124.

The second design for the vertical head rotation mechanism means 326, as also shown in FIG. 8, is comprised of a flexible head rod 328 having a lower end bore 330 and an upper end 332. The lower end bore 330 is linked to the lever arm 306 on the vertical miter gear 302 and the upper end 332 is rigidly attached to the rod attachment pin 206 located on the head 200. The vertical head rotation mechanism 326 functions in combination with the horizontal neck and head rotation mechanism 266 therefore, the vertical head rotation occurs simultaneously with the horizontal rotation of the neck and head.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. A mechanical biped assembly comprising:

a) a base assembly comprising: a lower section; an upper enclosure hingedly attached to said lower section and having an enclosure left leg opening, and a right foot attachment bore; and a spring attached between said lower section and said upper enclosure, wherein the spring maintains said upper enclosure biased in an upward position, b) a biped body comprising:

(1) a pelvic enclosure having an open upper section and an enclosed lower section having a pelvic left leg opening; a left leg having an upper pelvic opening placed and attached over the pelvic left leg opening, and a left foot having an enclosure opening placed over and attached to the enclosure left leg opening; and a right leg having an upper surface attached to the lower section of said pelvic enclosure and a lower foot attached, by an attachment means, to the right foot attachment bore, (2) a thorax enclosure comprising an enclosed upper section having a neck opening, an open lower section pivotally attached to the open upper section of said pelvic enclosure, a left section having a left arm opening, and a right section having a right arm opening; a left arm and a right arm having upper ends that are pivotally attached to each respective arm opening; and a neck having a lower edge inserted into the neck opening and an upper edge pivotally attached to a head, c) a kinematical linkage mechanism that is activated by a single depression of said upper enclosure, said mechanism comprising:

(1) a thorax movement mechanism means that is attached to and causes said thorax enclosure to pivot to the right of a vertical center line that bisects said biped body, (2) a left-arm movement mechanism means that is attached to and causes said left arm to pivot upward, (3) a right-arm movement mechanism means that is attached to and causes said right arm to move to the right, (4) a horizontal neck and head rotation mechanism means that is attached to and causes said neck and head to rotate to the left, and (5) a vertical head rotation mechanism means that is attached to and causrd said head to pivot upward.

2. The assembly as specified in claim 1 wherein said thorax movement mechanism means comprises a thorax rod having a lower end attached to the lower section of said base assembly, and an upper end attached to the left section of said thorax enclosure.

3. The assembly as specified in claim 2 wherein said left-arm movement mechanism means comprises: a left arm rod having a lower end and an upper end, wherein the lower end is rotatably attached to a left-arm support located on said pelvic enclosure; a gear rotation lever having a first end and a second end, wherein the first end is rotatably attached to the upper end of the left arm rod a gear enclosure having a first gear attached to the second end of said gear rotation lever, a second gear that meshes with the first gear, and a third gear that is attached to a gear support pin located on the upper end of said left arm.

4. The assembly as specified in claim 3 wherein said right-arm movement mechanism means comprises a right arm rod having a lower end rotatably attached to a right-arm rod support located on said pelyic enclosure, and an upper end rotatably attached to an arm pin lever located on the upper end of said right arm.

5. The assembly as specified in claim 4 wherein said horizontal neck and head rotation mechanism means comprises: a gear support bracket having a vertical section, and a horizontal section attached to a side of a thorax attachment pin that pivotally attaches said pelvic enclosure to said thorax enclosure, wherein the vertical section rotatably supports a vertical miter gear having attached a lever arm and a head rod attachment pin; a meshing horizontal miter gear having a rod bore into which is inserted and attached a neck support rod having a lower end that is rotatably attached to a neck rod support located on said pelvic section, and an upper end that is attached to and supports the lower end of said neck that protrudes through the neck opening on said thorax enclosure.

6. The assembly as specified in claim 5 wherein said vertical head rotation mechanism means comprises a flexible head rod having a lower end attached to the lever arm on the vertical miter gear, and an upper end attached to a rod attachment pin located on said head.

7. The assembly as specified in claim 6 wherein:

a) said thorax movement mechanism causes said thorax enclosure to pivot towards the right for a distance between 0.25 inches (0.635 cm) and 0.75 inches (1.91 cm), b) said left arm movement mechanism causes an upward movement ranging between 140 degrees and 160 degrees, c) said right arm movement mechanism causes an upward movement ranging between 15 degrees and 45 degrees, d) said horizontal neck and head rotation mechanism causes said neck and head to rotate to the left between 45 degrees and 90 degrees, and e) said vertical head rotation mechanism causes said head to rotate upward between 30 degrees and 60 degrees.

8. A mechanical biped assembly comprising:

A. a base assembly having:

a) a lower section having a rear panel, a left panel, a right panel, and a lower panel having a front edge, b) an upper enclosure dimensioned to slidably fit over said lower section, and having a rear panel, a left panel, a right panel, an upper panel, and a front panel terminating with a lower edge, with the upper panel having an enclosure left foot opening located adjacent the rear and left panels, and a right foot attachment bore located adjacent the rear and right panels, c) a hinge attached between the front edge of said lower section and the lower edge of said upper enclosure, d) a swivel pin bracket attached to the lower panel of the lower section adjacent the rear and left panels, e) a lower spring-attachment rod attached to the lower panel of the lower section adjacent the right panel and the front edge, f) an upper spring-attachment rod attached to the upper panel of the upper enclosure adjacent the left and right panels, and g) a spring attached between the lower and upper spring attachment rods, wherein said spring maintains the rear panel of the upper enclosure biased in an upward position but within the confines of the lower panel on the lower section.

B. a biped body comprising:

a) a pelvic enclosure having:

(1) an enclosed lower section integrally molded with a front section, a rear section, a left section, and: a right section, with the lower section having adjacent the left section a pelvic left leg opening, a neck rod support attached to the right of a vertical center line that bisects said biped body, a head rod support that is attached adjacent the right section, a right-arm rod support having an upper end and a lower end, and a left-arm rod support having an upper end and a lower end, wherein the lower ends are attached to the left of the vertical center line, (2) an open upper section having a front edge and a rear edge, (3) a front rod bracket and a rear rod bracket attached respectively along the vertical center line adjacent the front edge and the edge of said open upper section, b) a left leg having an upper pelvic opening placed and attached over the pelvic left leg opening on said pelvic enclosure, and a left foot having an enclosure opening placed and attached over the enclosure left foot opening on said upper enclosure, c) a right leg having an upper surface attached adjacent the right side of the enclosed lower section of said pelvic enclosure, and a right foot having attached thereto a threaded bolt that is inserted into the right foot attachment bore on said upper enclosure and subsequently tightened against the upper panel of said upper enclosure by a threaded nut, d) a thorax enclosure having:

(1) an enclosed upper section integrally formed with a front. section, a rear section, a left section, a right section, and an open lower section having a front edge and a rear edge, wherein the lower section is dimensioned and shaped to slidably fit into the upper section of said pelvic enclosure, (2) a thorax pin bore located along the vertical center line adjacent the front edge and the rear edge of the open lower section, wherein when a thorax attachment pin is inserted through each of the two thorax pin bores and into the respective front and rear rod brackets, said thorax enclosure is pivotally attached to said pelvis enclosure, (3) a swivel pin bracket attached to the left section adjacent the open lower section, (4) a left arm opening located on the left section adjacent the enclosed upper section, (5) a right arm opening located on the right section adjacent the enclosed upper section, wherein protruding from the right arm opening is a right-arm pin support, (6) a neck opening substantially centered on the enclosed upper section, e) a left arm having an upper end and a hand, with the upper end shaped and dimensioned to be inserted into the left arm opening and further having a gear support pin, f) a right arm having an upper end and a hand, with the upper end shaped and dimensioned to be inserted into the right arm opening, with the upper end further having an outward extending arm pin that is rotatably inserted into the right arm pin support located on said thorax enclosure, wherein the arm pin has attached normal to its surface a right-arm lever having an outer end with a normally extending rod attachment pin, g) a neck having a lower edge and an upper edge, wherein the lower edge is shaped and dimensioned to be pivotally inserted into the neck opening, wherein adjacent the lower edge is a neck support-rod pin bore, and adjacent the upper edge is a head pin bore, h) a head having a neck opening that is shaped and dimensioned to pivotally receive the upper edge of said neck, the neck opening further having adjacent thereto a neck pin bore, and a rod attachment pin that is located forward of the neck pin bore, wherein when a pin is inserted through the neck pin bore and the head pin bore said head is pivotally attached to the upper edge of said neck, C. a kinematical linkage mechanism comprising:

a) a thorax movement mechanism comprising a thorax rod having a lower end rotatably attached to a pin that is inserted through the swivel pin bracket located on the lower section of said base assembly, and an upper end rotatably attached to a swivel pin that is inserted through the pin bracket located on the left section of said thorax enclosure, wherein said thorax movement mechanism causes said thorax enclosure to pivot to the right of the vertical center line, b) a left-arm movement mechanism comprising:

(1) a left-arm rod having a lower end and an upper end, wherein the lower end is rotatably attached to a pin that is inserted through the left-arm rod support located on said pelvic enclosure, (2) a gear rotation lever having a first end and a second end, wherein the first end is rotatably attached to a pin that is inserted through the upper end of the left-arm rod, (3) a gear enclosure containing three gears, wherein the first gear is rotatably attached to the second end of said gear rotation lever, the second gear meshes with the first gear, and the third gear is attached to the gear support pin located on the upper end of said left arm, wherein said left-arm movement mechanism causes said left arm to pivot upward, c) a right-arm movement mechanism comprising a right-arm rod having a lower end and an upper end, wherein the lower end is rotatably attached to a pin that is inserted through the right-arm rod support located on said pelvic enclosure, and the upper end is rotatably attached to the rod attachment pin extending from the right-arm lever, wherein said right-arm movement mechanism causes said right arm to move upward, d) a mechanism means for causing said neck and head to rotate horizontally to the left, and e) a mechanism means for causing said head to pivot upward.

9. The assembly as specified in claim 8 wherein said biped body is in the shape of a child.

10. The assembly as specified in claim 8 wherein said biped body is in the shape of an extraterrestrial creature.

11. The assembly as specified in claim 8 wherein the three series gears are comprised of a first gear which rotates counter-clockwise, a second gear which rotates clockwise, and a third gear which rotates counter-clockwise wherein the first and second gear each have between thirteen teeth and nineteen teeth, and the third gear has between eight teeth and twelve teeth.

12. The assembly as specified in claim 8 wherein said thorax movement mechanism is designed to allow said thorax enclosure to pivot to the right for a distance between 0.25 inches (0.635 cm) and 0.75 inches (1.91 cm).

13. The assembly as specified in claim 12 wherein said left-arm movement mechanism is designed to produce an upward left arm movement ranging between 140 degrees and 160 degrees.

14. The assembly as specified in claim 13 wherein said right arm movement mechanism is designed to produce an upward right arm movement ranging between 15 degrees and 45 degrees.

15. The assembly as specified in claim 14 wherein said horizontal neck and head rotation mechanism causes said neck and head to rotate to the left between 45 degrees and 90 degrees.

16. The assembly as specified in claim 15 wherein said vertical head rotation mechanism causes said head to rotate upward between 30 degrees and 60 degrees as referenced from a horizontal line taken across the eyes of said biped.

17. The assembly as specified in claim 8 wherein said mechanism means for horizontally rotating said neck and head is provided by a horizontal neck and head rotation mechanism comprising:

a) a neck support rod sleeve rigidly attached to a side of the thorax attachment pin, and b) a neck support rotatably inserted into the neck support rod sleeve and having a lower bifurcated end that slips into the neck rod support located on said pelvic section, and an upper end bore aligned with the neck support rod pin bore located on said neck, wherein when a pin is inserted through both the upper end bore and the pin bore, said neck is rotatably attached to said thorax enclosure.

18. The assembly as specified in claim 17 wherein said mechanism means for vertically rotating said head is provided by a vertical head rotation mechanism comprising a flexible head rod having a lower end bore rotatably attached to the head rod support, and an upper end rigidly attached to the rod attachment pin located on said head.

19. The assembly as specified in claim 8 wherein said mechanism means for horizontally rotating said neck and head is provided by a horizontal neck and head rotation mechanism comprising:

a) a gear support bracket rigidly attached to a side of the thorax attachment pin, said bracket having a vertical section and a horizontal section, wherein the vertical section rotatably supports a vertical miter gear having a rear extending section from where extends normal a lever arm and a centrally aligned head rod attachment pin, and wherein the horizontal section having a rod bore, that is dimensioned to rotatably support a horizontal miter gear also having a rod bore in alignment with the rod bore on said horizontal section and that meshes with the vertical miter gear, and b) a neck support rod that is rigidly positioned into the rod bore in the horizontal miter gear, rotatably inserted into the rod bore in said horizontal section, and having a lower bifurcated end that slips into the neck rod support located on said pelvic enclosure, and an upper end bore aligned with the neck support rod pin bore located on said neck, wherein when a pin is inserted through the upper end bore and the pin bore, said neck is rotatably attached to said thorax enclosure.

20. The assembly as specified in claim 19 wherein said mechanism means for vertically rotating said head is provided by a vertical head rotation mechanism comprising a flexible head rod having a lower end bore linked to the lever arm on the vertical miter gear, and an upper end rigidly attached to the rod attachment pin located on said head.

* * * * *